US011351600B2

(12) United States Patent
Suzuki et al.

(10) Patent No.: US 11,351,600 B2
(45) Date of Patent: Jun. 7, 2022

(54) NOZZLE, CASTING APPARATUS, AND CAST PRODUCT MANUFACTURING METHOD

(71) Applicant: NGK INSULATORS, LTD., Nagoya (JP)

(72) Inventors: Ken Suzuki, Chita-Gun (JP); Naokuni Muramatsu, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 96 days.

(21) Appl. No.: 16/575,880

(22) Filed: Sep. 19, 2019

(65) Prior Publication Data

US 2020/0009649 A1 Jan. 9, 2020

Related U.S. Application Data

(63) Continuation of application No. PCT/JP2018/008849, filed on Mar. 7, 2018.

(30) Foreign Application Priority Data

Mar. 31, 2017 (JP) ..... JP2017-070975

(51) Int. Cl.
*B22D 41/50* (2006.01)
*B22D 11/117* (2006.01)
*B22D 11/14* (2006.01)

(52) U.S. Cl.
CPC ..... *B22D 41/50* (2013.01); *B22D 11/117* (2013.01); *B22D 11/141* (2013.01); *B22D 11/145* (2013.01)

(58) Field of Classification Search
CPC ..... B22D 11/004; B22D 11/117; B22D 11/14; B22D 11/141; B22D 11/145; B22D 41/50
USPC ..... 164/475, 415, 437, 488; 222/590, 591, 222/594, 606
See application file for complete search history.

(56) References Cited

U.S. PATENT DOCUMENTS 3,578,064 A * 5/1971 Mills et al. ..... B22D 11/10 164/437

FOREIGN PATENT DOCUMENTS

| | | | | |
|---|---|---|---|---|
| CN | 204842961 U | * | 12/2015 | ..... B22D 41/50 |
| EP | 0 362 983 A1 | | 4/1990 | |
| EP | 1 112 792 A2 | | 7/2001 | |
| EP | 2 501 507 B1 | | 6/2016 | |
| JP | S49-040656 Y1 | | 11/1974 | |
| JP | S61-262450 A1 | | 11/1986 | |
| JP | H02-284751 A1 | | 11/1990 | |
| JP | 2004-174513 A1 | | 6/2004 | |
| JP | 2004-344900 A1 | | 12/2004 | |
| JP | 2014-144484 A1 | | 8/2014 | |
| WO | 2010/133765 A1 | | 11/2010 | |
| WO | 2011/061397 A1 | | 5/2011 | |

OTHER PUBLICATIONS

Machine translation of CN 204842961 U (Year: 2015).*

(Continued)

*Primary Examiner* — Kevin P Kerns
(74) *Attorney, Agent, or Firm* — Burr & Brown, PLLC

(57) ABSTRACT

A nozzle put into a molten metal in vertical upwards continuous casting for casting a cast product by pulling up the molten metal, the nozzle includes a nozzle body having an intake hole through which the molten metal is taken in and which is formed in a lateral surface of the nozzle body and a flange portion formed on lower side of the intake hole and projecting beyond the nozzle body.

10 Claims, 8 Drawing Sheets

(56) References Cited

OTHER PUBLICATIONS

Naokuni Muramatsu, et al., "Characteristics of Hypoeutectic Cu—Zr Alloy Rods Manufactured by Vertically Upwards Continuous Casting," *Materials Transactions*, vol. 57, No. 10 (2016), Japan Copper Alloy and Brass Association, pp. 1794-1800.
International Search Report and Written Opinion (Application No. PCT/JP2018/008849) dated May 15, 2018.
Extended European Search Report (Application No. 18778093.7) dated Oct. 5, 2020.
English translation of International Preliminary Report on Patentability (Chapter I) (Application No. PCT/JP2018/008849) dated Oct. 10, 2019, 6 pages.
Korean Office Action (Application No. 10-2019-7027943) dated Nov. 11, 2020 (with English translation).

* cited by examiner

Fig. 7

| | Experimental Example 1 | Experimental Example 2 | Experimental Example 3 | Experimental Example 4 | Experimental Example 5 |
|---|---|---|---|---|---|
| Prevention of slag adhesion at the time of putting the nozzle into the molten metal | B | A | A | A | AA |
| Prevention of intrusive mixing of inclusions during the casting | D | D | B | A | AA |
| Outline shape | 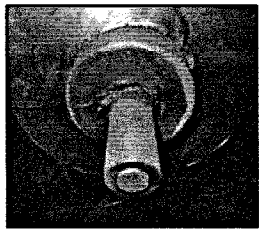 (At the time of putting the nozzle into the molten metal) (During the casting) 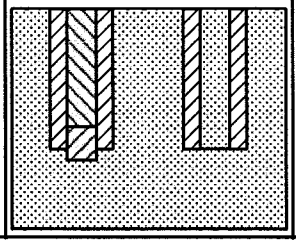 | 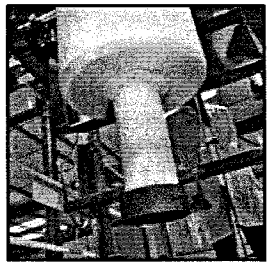 (At the time of putting the nozzle into the molten metal) (During the casting) 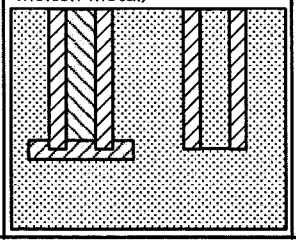 | 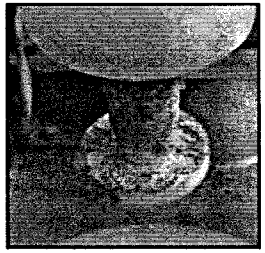 (At the time of putting the nozzle into the molten metal) (During the casting) 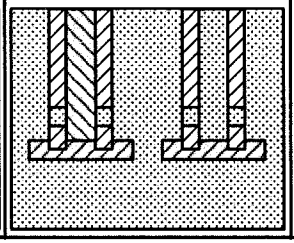 | 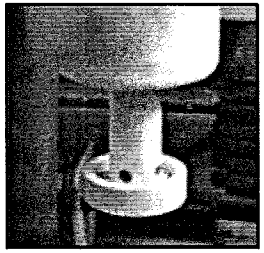 (At the time of putting the nozzle into the molten metal) (During the casting) 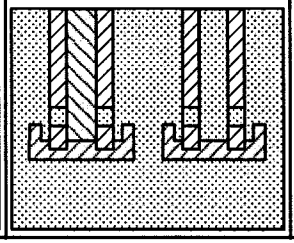 | 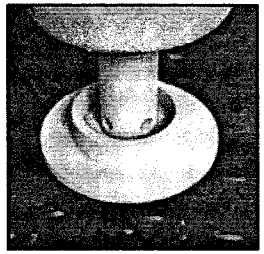 (At the time of putting the nozzle into the molten metal) (During the casting) 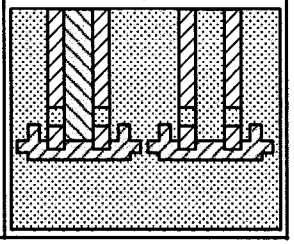 |

NOZZLE, CASTING APPARATUS, AND CAST PRODUCT MANUFACTURING METHOD

BACKGROUND OF THE INVENTION

1. Field of the Invention

This Description discloses a nozzle, a casting apparatus, and a cast product manufacturing method.

BACKGROUND ART

2. Description of the Related Art

According to a cast product manufacturing method that has hitherto been proposed, a plate for preventing intrusion of slag is attached to a nozzle, the nozzle is put into a molten metal, and casting is carried out after removing the plate (see, e.g., Patent Literature (PTL) 1). That manufacturing method is explained as being able to purify a cast slab in a simple manner with a low cost.

CITATION LIST

Patent Literature

PTL 1: Japanese Unexamined Patent Application Publication No. 2004-174513

SUMMARY OF THE INVENTION

As an example of casting methods, there is known vertical upwards continuous casting for casting a cast product by pulling up a molten metal. Generally, in a step of dissolving a metal, slag floats on an upper surface of the molten metal. According to the above casting method, however, the nozzle used for the casting needs to be put into the molten metal from above. Therefore, the above casting method has the following problem. Slag adheres to a nozzle tip and is caught into the molten metal, thus producing inclusions. During subsequent casting, the inclusions come into the nozzle and are taken into a casting material. As a result, quality of the cast product degrades. In some cases, refractory materials, insulation materials, etc. other than the slag may drop to the surface of the molten metal and may be caught into the molten metal, thus producing inclusions. According to the cast product manufacturing method disclosed in PTL 1, intrusion of the slag into the nozzle is prevented, for example, by attaching the plate for preventing the intrusion of the slag into the nozzle, and by putting the nozzle into the molten metal. However, the intrusion of the slag is not yet sufficiently prevented, and an increase of purification due to further improvements is demanded.

In view of the above-described problem, a main object of the present disclosure is to provide a nozzle, a casting apparatus, and a cast product manufacturing method, which can more reliably suppress inclusions present in a molten metal from being intrusively mixed into a cast product in vertical upwards continuous casting.

As a result of conducting intensive studies with intent to achieve the above main object, the inventors have found that, with a structure causing a molten metal to be taken in from the lateral side and including a flanged portion formed in a projecting shape on the lower side of an intake hole, inclusions can be avoided from directly coming into a nozzle and can be more reliably prevented from being mixed into a cast product because the inclusions tend to usually float upwards. On the basis of the above finding, the inventors have accomplished the nozzle, the casting apparatus and the cast product manufacturing method according to the present disclosure.

This Description discloses a nozzle and put into a molten metal in vertical upwards continuous casting for casting a cast product by pulling up the molten metal, the nozzle including:

a nozzle body having an intake hole through which the molten metal is taken in and which is formed in a lateral surface of the nozzle body; and a flange portion formed on the lower side of the intake hole and projecting beyond the nozzle body.

Furthermore, this Description discloses a casting apparatus that carries out vertical upwards continuous casting for casting a cast product by pulling up a molten metal, the casting apparatus including:

a storage section storing the molten metal;

an inclusion removal unit put into the storage section, performing bubbling in the molten metal with inert gas, and causing inclusions in the molten metal to float upwards;

the above-described nozzle put into the storage section and taking in the molten metal; and a cooling unit disposed above the nozzle and quenching the taken-in molten metal.

Moreover, this Description discloses a cast product manufacturing method of carrying out vertical upwards continuous casting for casting a cast product by pulling up a molten metal, the cast product manufacturing method including:

an inclusion removal step of performing bubbling in the molten metal with inert gas and causing the inclusions in the molten metal to float upwards; and a casting step of, after the inclusion removal step, moving the above-described nozzle downwards to be put into the molten metal, taking in the molten metal, and casting the cast product.

The nozzle, the casting apparatus, and the cast product manufacturing method according to the present disclosure can more reliably suppress intrusive mixing of the inclusions into the cast product in the vertical upwards continuous casting. The reason is presumably as follows. In an example, the nozzle includes the intake hole formed on the lateral side and the flange portion formed on the lower side of the intake hole and projecting beyond the nozzle body. Therefore, when the nozzle is moved downwards and is put into the molten metal on an upper surface of which slag is floating, the slag can be prevented from approaching the intake hole with the presence of the flange portion. In addition, even when the inclusions float upwards from below during the casting, the nozzle can take in the molten metal from the lateral side while preventing the inclusions from approaching the intake hole with the presence of the flange portion formed in the projected shape. As a result, the inclusions can be more reliably suppressed from being intrusively mixed into the cast product in the vertical upwards continuous casting.

BRIEF DESCRIPTION OF THE DRAWINGS

FIG. 7 is an explanatory view representing experimental results of Experimental Examples 1 to 5 regarding prevention of slag adhesion and prevention of intrusive mixing of inclusions.

DETAILED DESCRIPTION OF THE INVENTION

Figure 1A:
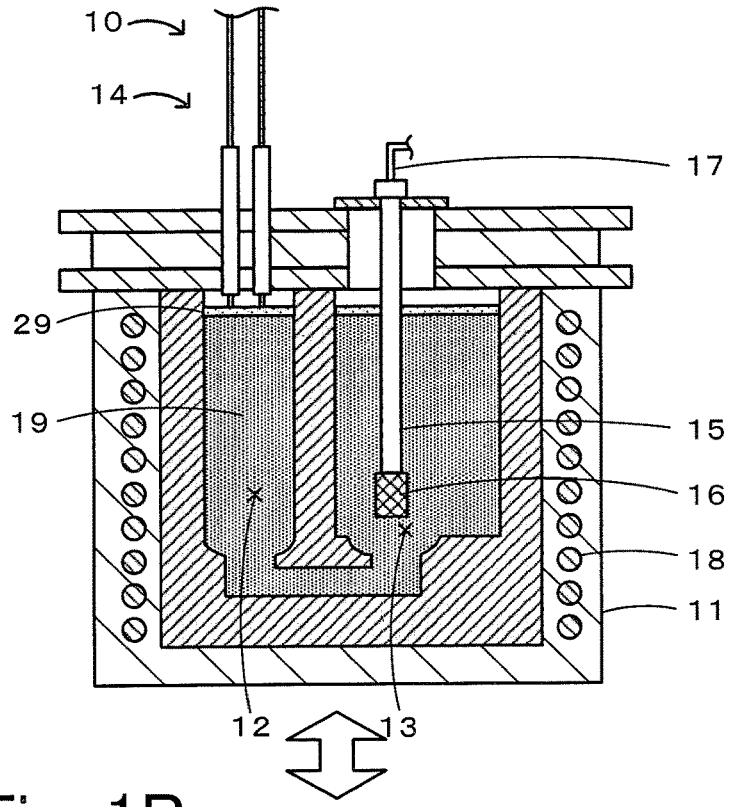
FIGS. 1A and 1B are an explanatory view schematically illustrating an example of a casting apparatus 10.
Figure 1B:
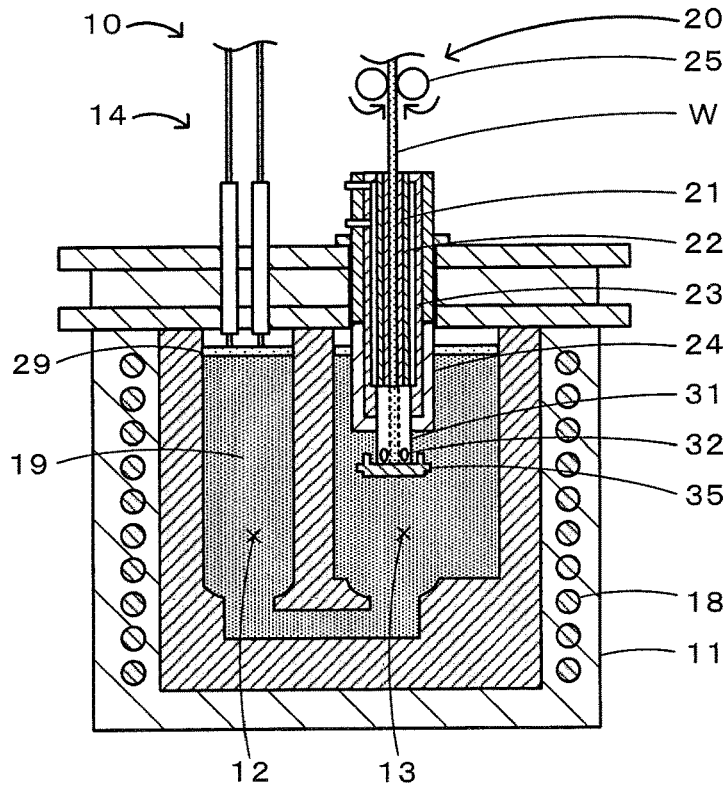
Figure 2:
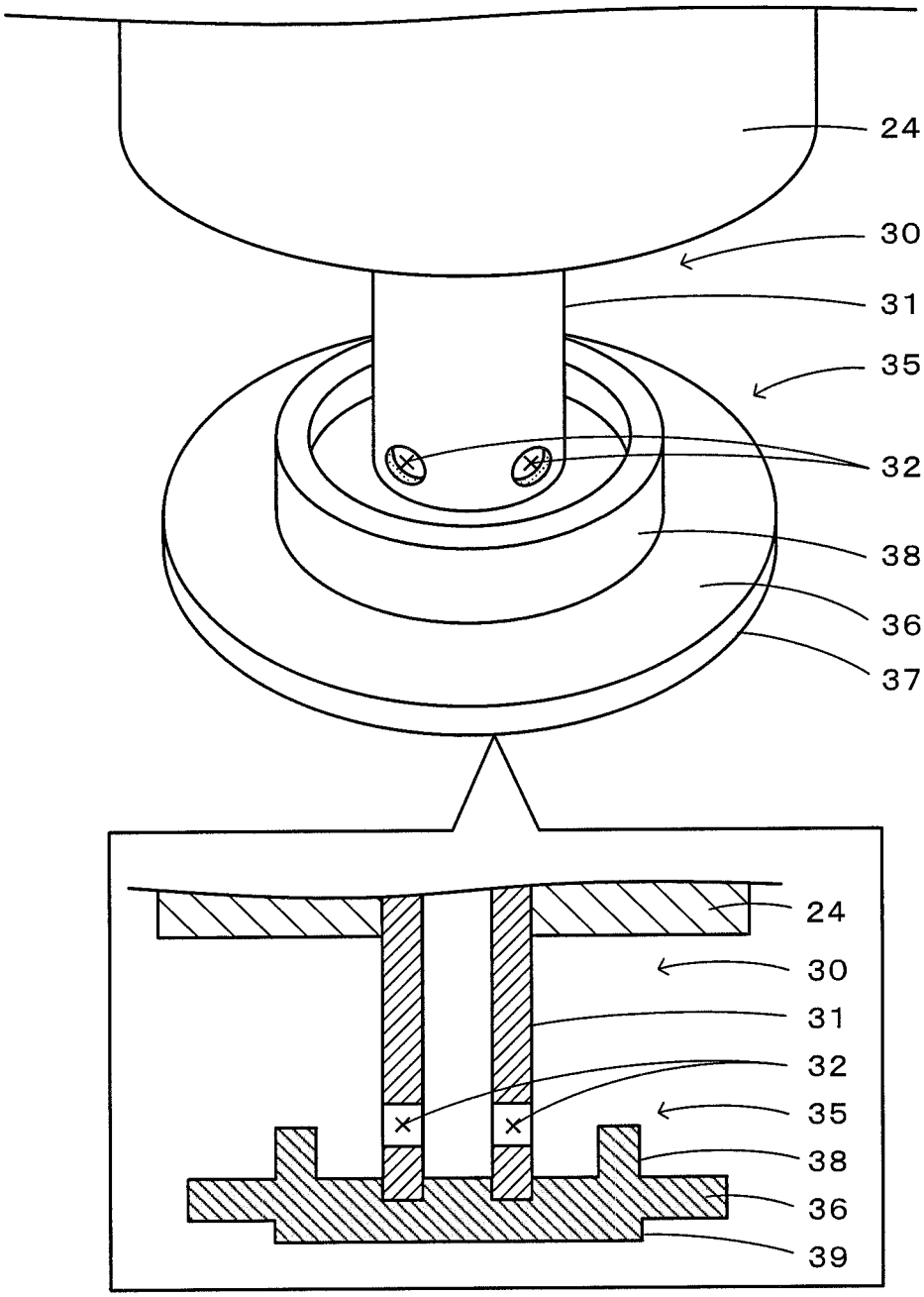
FIG. 2 is an explanatory view illustrating an example of a nozzle 30 and a cap member 35.
Figure 3:
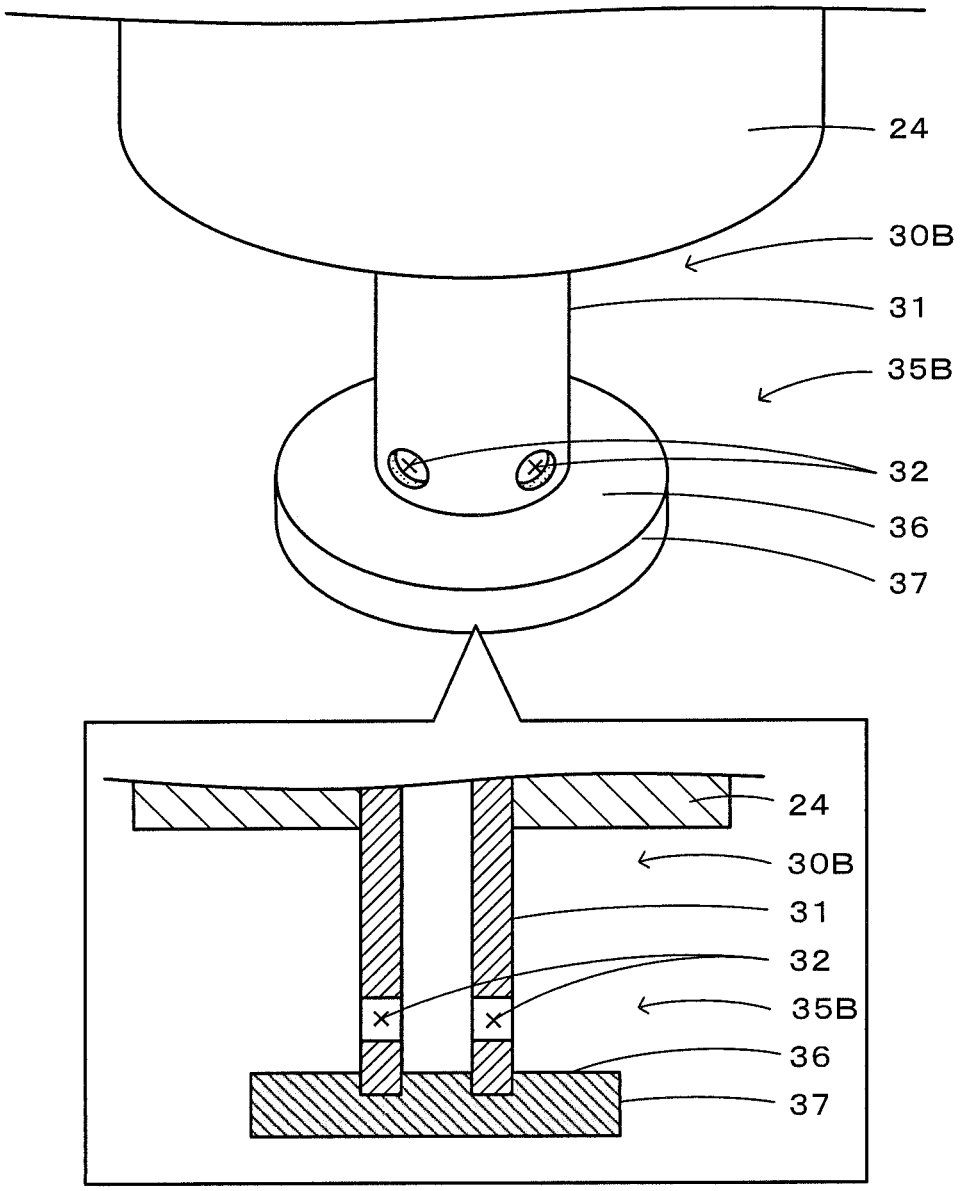
FIG. 3 is an explanatory view illustrating an example of a nozzle 30B and a cap member 35B.
Figure 4:
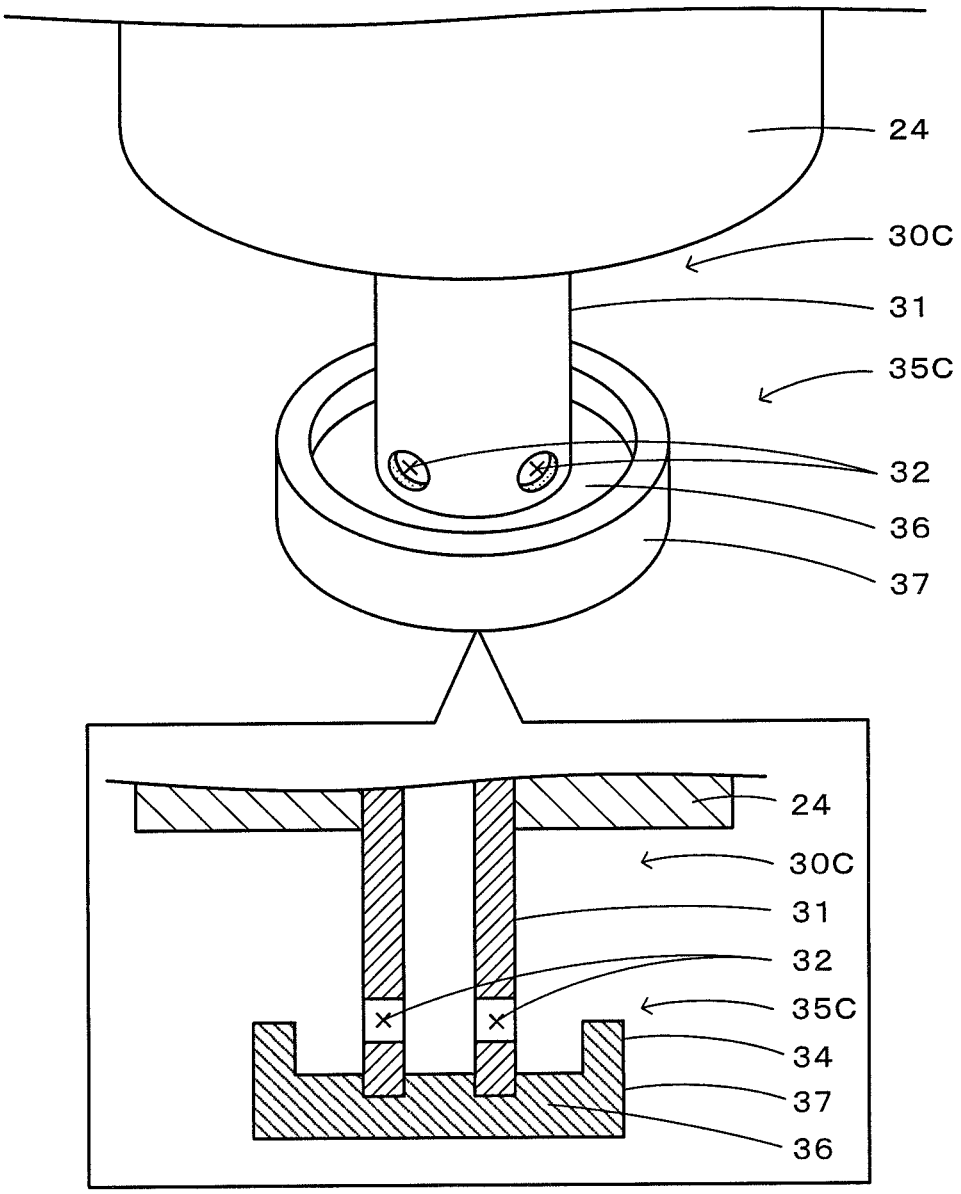
FIG. 4 is an explanatory view illustrating an example of a nozzle 30C and a cap member 35C.

An embodiment of the present disclosure will be described below with reference to the drawings. FIGS. 1A and 1B are an explanatory view schematically illustrating an example of a casting apparatus 10 according to an embodiment of the present disclosure; specifically, FIG. 1A represents a state in which an inclusion removal unit 15 is mounted, and FIG. 1B represents a state in which a casting unit 20 is mounted. FIG. 2 is an explanatory view illustrating an example of a nozzle 30 and a cap member 35. FIG. 3 is an explanatory view illustrating an example of another nozzle 30B and another cap member 35B. FIG. 4 is an explanatory view illustrating an example of another nozzle 30C and another cap member 35C.

The casting apparatus 10 is to carry out vertical upwards continuous casting for casting a cast product by pulling up a molten metal. For example, a pure metal and an alloy can be used as raw materials for the cast product that is to be cast by the casting apparatus 10. The pure metal may be, for example, oxygen-free copper, tough pitch copper, or deoxidized copper. The alloy may be, for example, a copper alloy or an aluminum alloy. The copper alloy may be, for example, one or more among Cu—Zr, Cu—Sn, Cu—Fe and Cu—Ag alloys and multi-element copper alloys containing some of those elements. Here, the "multi-element copper alloys" are assumed to include alloys containing a third element in addition to the above-mentioned two-element copper alloys. The third element may be, for example, one or more among Ni, Si, Al, etc. The following description is mainly made in connection with the case of using the Cu—Zr alloy. The Cu—Zr alloy may be, for example, a Cu-xZr alloy (where x is not less than 0.5 at % and not more than 5.0 at %) having a hypo-eutectic composition. That alloy can provide a fine dendrite structure and, when subjected to wire drawing, it can further provide a nano-layered structure in an a-Cu phase and a eutectic phase (dual-phase of Cu and a Cu—Zr compound). Hence an alloy with high strength and high conductivity can be obtained. Details of the Cu-xZr alloy are disclosed in Japanese Patent No. 5800300, and detailed description of the Cu-xZr alloy is omitted here.

The casting apparatus 10 includes a first storage section 12, a second storage section 13, an inclusion removal unit 15, and a casting unit 20. The casting apparatus 10 further includes a housing 11, a material supply unit 14, and a heating unit 18. The first storage section 12 and the second storage section 13 are defined in the housing 11. The housing 11 has openings through which the material supply unit 14 and the casting unit 20 are inserted. However, the inside of the housing 11 can be brought into an enclosed state by closing the openings with closure plates or the likes. The first storage section 12 and the second storage section 13 are to store a molten metal 19. The first storage section 12 is positioned on the material supply side, and the material supply unit 14 is disposed above the first storage section 12. The second storage section 13 is positioned on the casting side where the molten metal 19 is pulled up for manufacturing of a cast product, and the casting unit 20 is disposed above the second storage section 13. The first storage section 12 and the second storage section 13 are communicated with each other through a flow path formed under both the storage sections. An inert gas supply unit (not illustrated) is connected to the first storage section 12 and the second storage section 13 such that an inert gas atmosphere can be produced in each of the storage sections. The inert gas may be, for example, rare gas such as Ar, or nitrogen gas. Of those gases, Ar is preferable.

The material supply unit 14 is a unit for supplying raw materials for the molten metal 19. The material supply unit 14 may feed, for example, wires made of a main component and an additive component of an alloy. When manufacturing a cast product of the Cu—Zr alloy, for example, the material supply unit 14 may feed a Cu-wire and a copper pipe, which is made of a raw material containing Zr, to the first storage section 12 with adjustment for holding a predetermined Zr content. The raw material to be contained in the copper pipe is preferably a mother alloy of Cu—50 mass % of Zr. This is because the above mother alloy has a lower melting point (1168K) than that (2125K) of the Zr metal. The material supply unit 14 may sequentially feed, to the first storage section 12, a certain amount of the raw material corresponding to an amount of the molten metal that has been cast in the casting unit 20 and taken out to the outside.

The inclusion removal unit 15 is to remove inclusions present in the molten metal 19. The inclusions may be, for example, impurity components contained in the raw materials, slag caught into the molten metal, and parts of structural members of the casting apparatus 10, such as a crucible and refractories, the parts being mixed into the molten metal 19. The inclusion removal unit 15 may be put into the second storage section 13 to perform bubbling in the molten metal 19 with inert gas, thus causing the inclusions in the molten metal 19 to float upwards. The inclusion removal unit 15 may perform the bubbling with the inert gas in a stationary state, or may perform the bubbling with the inert gas in a state in which vanes are attached to a tip of the inclusion removal unit 15 and are rotated about an axis to stir the inert gas. The inclusion removal unit 15 includes a porous plug 16 and a gas supply pipe 17. The porous plug 16 is a porous member through which the inert gas fed from the gas supply pipe 17 is discharged in the bubbled form. The porous plug 16 is preferably made of a porous material with low reactivity to the molten metal 19, and it may be made of ceramic or carbon, for example. A ceramic material is just required to have low reactivity to the molten metal 19 and to withstand the temperature of the molten metal 19. The ceramic material may be, for example, one or more among alumina, zirconia, silica, silicon nitride, etc. In the casting apparatus 10, casting is carried out after the bubbling by the inclusion removal unit 15. Thus, in the casting apparatus 10, after causing the inclusions to float upwards by the inclusion removal unit 15, the inclusion removal unit 15 is replaced with the casting unit 20, followed by casting of a cast product W. Many of the inclusions are lighter than the molten metal 19 and are apt to easily float upwards. However, fine inclusions float upwards at low speed and tend to remain in the molten metal. With the bubbling, because the inclusions are caused to float upwards in a state adhering to bubbles, it is possible to more stably remove the inclusions from the molten metal, and to purify the molten metal 19. A slag layer in which the inclusions are floating is formed in an upper surface of the molten metal 19.

The heating unit 18 is disposed around the first storage section 12 and the second storage section 13. The heating unit 18 is a heater capable of heating the metals as the raw materials to fusible temperature. The heating temperature may be, for example, in the range of not lower than 1500K and not higher than 2000K.

The casting unit 20 is a unit for quenching the molten metal 19 while pulling up the same, thereby forming a cast product in the form of a wire rod. The casting unit 20 is vertically movable such that it is put into the second storage section 13 during the casting and is taken out from the second storage section 13 after the end of the casting. The casting unit 20 includes a die 21, a mold 22, a cooling unit 23, a cap 24, rollers 25, and a nozzle 30. The die 21 is disposed inside the mold 22 and constitutes a former for the cast product W together with the mold 22. The die 21 is a cylindrical member made of carbon, for example. The cast product W is formed in a shape in match with an inner diameter shape of the die 21. The mold 22 is a cylindrical member made of Cu, for example. The nozzle 30 is detachably attached to a tip of the die 21. The cooling unit 23 is a unit for cooling the mold 22 and is disposed above the nozzle 30. The cooling unit 23 quenches the molten metal 19 taken in through the nozzle 30. Cooling water is supplied to the cooling unit 23 from a circulation unit (not illustrated), and after cooling the mold 22, the cooling water is discharged to the circulation unit. The cap 24 is a member for protecting the mold 22 and the nozzle 30 from the molten metal 19. For example, ceramic or carbon may be used as a material of the cap 24. The rollers 25 are disposed above the mold 22. The rollers 25 are rotated in a state gripping the cooled cast product W between them, thus pulling up the cast, and are driven by a motor (not illustrated).

The nozzle 30 is used in the vertical upwards continuous casting for casting the cast product W by pulling up the molten metal 19. The nozzle 30 is a member that is directly put into the molten metal 19. A material of the nozzle 30 is selected as appropriate depending on the type of the molten metal 19, and it may be, for example, carbon or ceramic such as alumina, zirconia, silica, or silicon nitride. When the molten metal 19 is a copper alloy, the nozzle 30 is preferably made of carbon. The nozzle 30 is constituted by a nozzle body 31 and a cap member 35. The nozzle body 31 is a cylindrical member and is fixedly fitted to a tip of the mold 22. An inner space of the nozzle body 31 is communicated with an inner space of the die 21. An intake hole 32 through which the molten metal 19 is taken in is formed in a lateral surface of the nozzle body 31. Furthermore, as illustrated in FIG. 2, a lower opening of the nozzle body 31 is closed by the cap member 35. Thus, in the nozzle body 31, the molten metal 19 is taken in from the lateral side. Accordingly, the nozzle body 31 has a structure of being less apt to take in the inclusions, which are lighter than the molten metal 19 and tend to float upwards, than the case of taking in the molten metal 19 from the lower opening. Before the start of the casting, a starting rod 26 (see FIGS. 5A to 5C) is inserted into the nozzle body 31. By lifting the starting rod 26, the molten metal 19 is pulled up to the die 21 for casting of the cast product W.

The cap member 35 is to suppress the inclusions in the molten metal 19 from coming into the nozzle 30. The cap member 35 includes a flange portion 36 formed on the lower side of the intake hole 32 and projecting beyond the nozzle body 31. The flange portion 36 may be formed entirely along the outer peripheral side of the nozzle body 31. When the nozzle 30 is put into the molten metal 19, the nozzle 30 passes through a slag layer 29 (see FIGS. 1A and 1B) in which the inclusions are floating. The flange portion 36 may be formed in size that is appropriate to suppress the inclusions from entering the intake hole 32 when the nozzle 30 is put into the molten metal 19. Moreover, the flange portion 36 preferably has a smaller size than a body of the casting unit 20, such as the cap 24. This is because the flange portion 36 having the smaller size improves operability when it is put into or taken out from the second storage section 13. As illustrated in FIG. 2, the flange portion 36 includes a rising wall 38 formed between an outer peripheral edge 37 and the nozzle body 31 and vertically rising in a fashion coming closer to the intake hole 32. With the presence of the rising wall 38, the inclusions can be suppressed from approaching the intake hole 32. The rising wall 38 may be formed entirely along the outer peripheral side of the nozzle body 31. The rising wall 38 may have such a height as covering about a half of the intake hole 32, or covering a region up to a lower end of an opening of the intake hole 32, or covering the whole of the intake hole 32. The height of the rising wall 38 may be appropriately set in consideration of the balance between easiness in taking in the molten metal 19 through the intake hole 32 and the effect of suppressing the inclusions from entering the intake hole 32. In addition, a stepped portion 39 being relatively thick in a central portion (relatively thin in an outer peripheral portion) is formed on the lower surface side of the cap member 35. The stepped portion 39 has the function of, for example, suppressing entrapment of the slag layer 29 when the nozzle 30 is put into the molten metal 19.

The nozzle 30 has been described above as including the cap member 35 provided with the rising wall 38, but the rising wall 38 may be omitted in another example as illustrated in FIG. 3. A nozzle 30B includes a cap member 35B provided with only the flange portion 36. The nozzle 30B can also suppress the inclusions from approaching the intake hole 32. Furthermore, the nozzle 30 has been described above as including the cap member 35 provided with the rising wall 38 between the nozzle body 31 and the outer peripheral edge 37, but an outer edge wall 34 may be formed, as illustrated in FIG. 4, at the outer peripheral edge 37 of the flange portion 36 in still another example. A nozzle 30C includes a cap member 35C in which the outer edge wall 34 vertically rising in a fashion coming closer to the intake hole 32 is formed at the outer peripheral edge 37. The presence of the outer edge wall 34 can further suppress the inclusions from approaching the intake hole 32. The outer edge wall 34 may be formed to rise entirely along the outer peripheral side of the nozzle body 31. A height of the outer edge wall 34 may be appropriately set as in the case of the rising wall 38. The nozzle 30C can also reliably suppress the inclusions from approaching the intake hole 32. The nozzle 30 may be modified such that the stepped portion 39 is not formed, or that the stepped portion 39 is formed in the nozzles 30B or 30C. The nozzle 30, 30B or 30C may include a portion which is located in a region other than just under the intake hole 32 and in which the flange portion 36 is not formed. Furthermore, the nozzle 30 or 30C may include a portion which is located in a region other than just on the lateral side of the intake hole 32 and in which the outer edge wall 34 or the rising wall 38 is not formed. The outer edge wall 34 may be further formed at the outer peripheral edge 37 in the nozzle 30. Although the cap member is a separate member in the nozzles 30, 30B and 30C, the nozzle body 31 may be integrally formed with any of the cap members 35, 35B and 35C. Such an integrally formed nozzle can also provide similar advantageous effects to those described above.

Figure 5A:
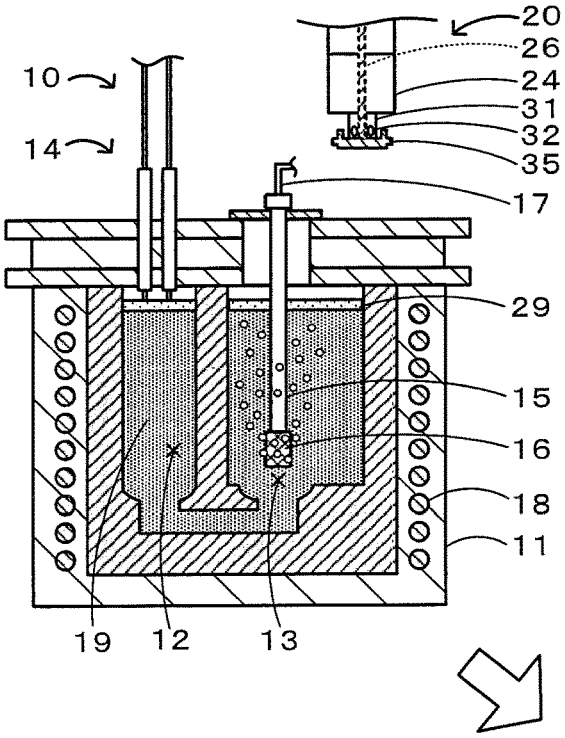
FIGS. 5A to 5C are an explanatory view representing steps of manufacturing a cast product W by vertical upwards continuous casting.
Figure 5B:
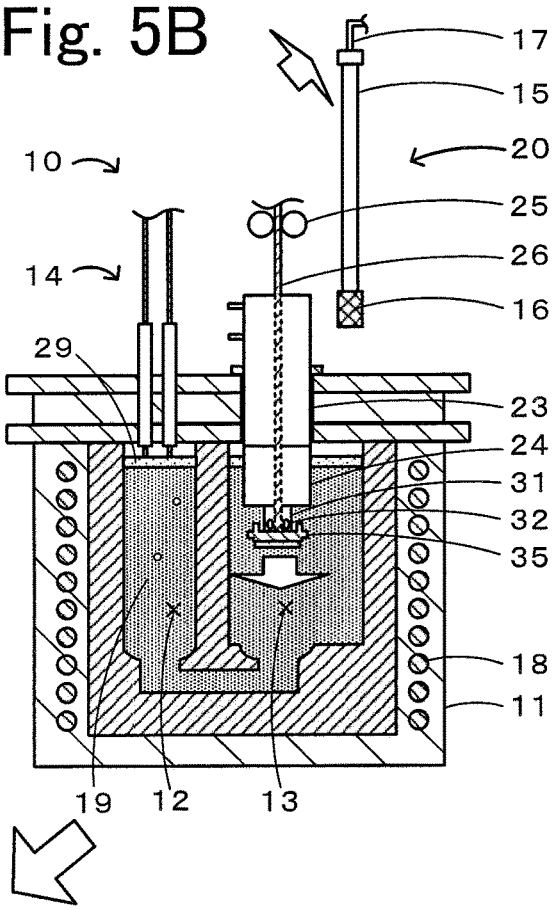
Figure 5C:
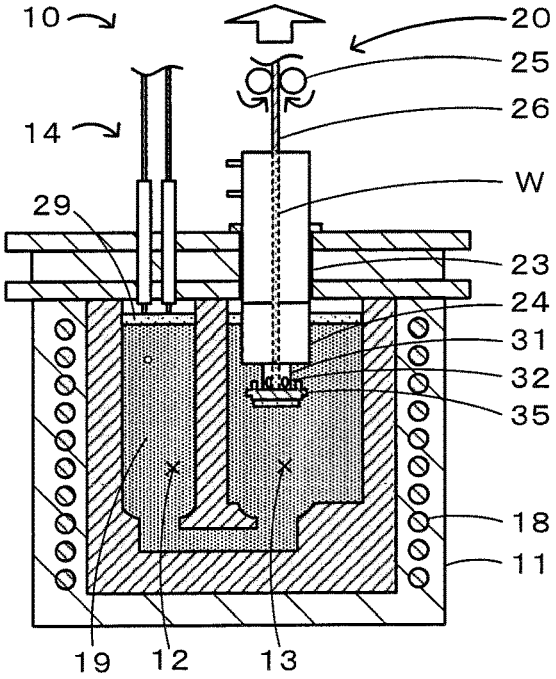

A cast product manufacturing method of carrying out the vertical upwards continuous casting for casting the cast product W by pulling up the molten metal 19 will be described below. The cast product manufacturing method is described on an assumption that the method is implemented using the casting apparatus 10. The cast product manufacturing method may include, for example, (1) heating step, (2) inclusion removal step, and (3) casting step. FIGS. 5A to 5C are an explanatory view illustrating steps of manufacturing the cast product W by the vertical upwards continuous casting. FIG. 5A is an explanatory view representing the inclusion removal step, FIG. 5B is an explanatory view representing a state in which the nozzle 30 is put into the molten metal, and FIG. 5C is an explanatory view representing a state at the start of the casting.

(1) Heating Step

In this step, a process of supplying raw materials into the first storage section 12 and the second storage section 13, heating and dissolving the raw materials, and preparing the molten metal is performed. The above-described examples of the alloy and the pure metal can be used as the raw materials. The heating temperature can be set as appropriate depending on the raw materials. In the case of using the Cu—Zr alloy having the hypo-eutectic composition, the heating temperature may be set to 1573K or higher, for example.

(2) Inclusion Removal Step

In this step, a process of performing bubbling in the molten metal 19 with inert gas and causing the inclusions in the molten metal to float upwards (see FIG. 5A) is performed. With this process, the molten metal can be purified. The inclusion removal unit 15 may be put into the second storage section 13 after the heating step. A processing time of this step may be set as appropriate depending on the type and amount of the molten metal 19. An amount of gas to be supplied may also be set as appropriate set depending on the type and amount of the molten metal 19. The inert gas used for the bubbling may be, for example, rare gas such as Ar, or nitrogen gas. Of those gases, Ar is preferable.

(3) Casting Step

In this step, a process of moving the nozzle 30 mounted to the casting unit 20 downwards to be put into the molten metal 19, taking in the molten metal through the nozzle 30, and casting the cast product W is performed. In this step, a process of cooling the molten metal 19, which has been pulled up through the nozzle 30, by the cooling unit 23 disposed above the nozzle 30 (i.e., a quenching process) is further performed. When the nozzle 30 is put into the molten metal 19, the starting rod 26 is in a state inserted through the die 21 and the nozzle body 31. When putting the nozzle 30 into the molten metal 19 in this process, the nozzle 30 passes through the slag layer 29. However, since the cap member 35 is disposed at the lower end of the nozzle 30, the inclusions can be reliably suppressed with the presence of the flange portion 36 from approaching the intake hole 32 (FIG. 5B). Furthermore, since the intake hole 32 is formed in the lateral surface of the nozzle body 31, the inclusions are harder to approach the intake hole 32. When the starting rod 26 is lifted by rotation of the rollers 25, the molten metal 19 is also pulled up together with the starting rod 26 and is quenched by the cooling unit 23, whereby the cast product W is cast (FIG. 5C). On that occasion, the inclusions present in the molten metal 19 may float toward the slag layer 29 in some cases. However, since the intake hole 32 is formed in the lateral surface of the nozzle body 31 and the flange portion 36 is present on the lower side of the intake hole 32, the inclusions are harder to come into the nozzle 30.

In the casting apparatus 10 described above, the nozzle 30 includes the intake hole 32 formed on the lateral side and the flange portion 36 formed on the lower side of the intake hole 32 and projecting beyond the nozzle body. Therefore, when the nozzle 30 is put into the molten metal 19, the inclusions can be prevented from approaching the intake hole 32. Furthermore, even when the inclusions float upwards from below during the casting, the nozzle 30 can take in the molten metal from the lateral side while preventing the inclusions from approaching the intake hole with the presence of the flange portion 36 formed in the projected shape. As a result, the casting apparatus 10 can reliably suppress the inclusions from being intrusively mixed into the cast product in the vertical upwards continuous casting.

It is needless to say that the present disclosure is not limited to the above embodiment and it can be variously implemented in various forms insofar as falling within the technical scope of the present disclosure.

Figure 6:
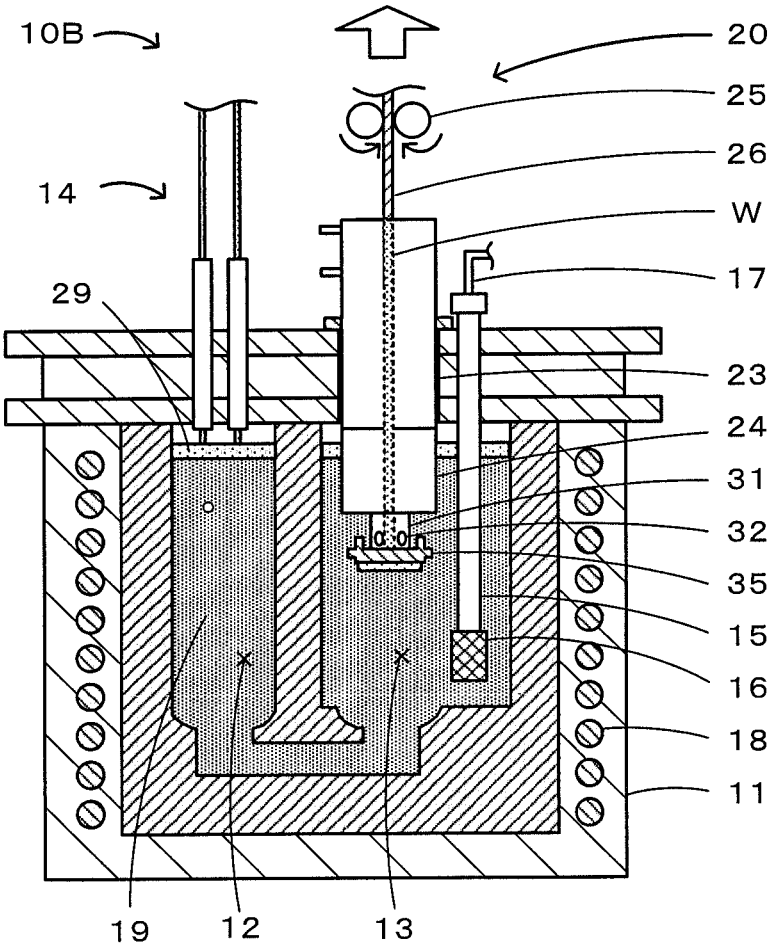
FIG. 6 is an explanatory view schematically illustrating an example of another casting apparatus 10B.

For instance, while, in the above embodiment, the casting apparatus 10 is described as causing the inclusions to float upwards by the inclusion removal unit 15, then replacing the inclusion removal unit 15 with the casting unit 20, and carrying out casting of the copper alloy, the present disclosure is not limited to that case. FIG. 6 is an explanatory view schematically illustrating an example of another casting apparatus 10B. As illustrated in FIG. 6, the inclusion removal unit 15 may be permanently disposed in the molten metal, and the cast product W may be cast by the casting unit 20 after causing the inclusions to float upwards by the permanent inclusion removal unit 15. The above-described casting apparatus 10B can also reliably suppress the inclusions from being intrusively mixed into the cast product in vertical upwards continuous casting.

While the above embodiment has been described in connection with the casting apparatus 10, the present disclosure may be implemented as the nozzle 30. The nozzle 30 can also provide similar advantageous effects to those obtained with the casting apparatus 10.

EXAMPLES

Examples of actually fabricating the casting apparatus 10 and the nozzle 30 will be described below as Experimental Examples. The above-described casting apparatus 10 was fabricated and degrees of intrusive mixing of inclusions into cast products were studied while the shape of the nozzle and the shape of the cap member were changed. Experimental Examples 3 to 5 and 7 correspond to Examples, and Experimental Examples 1, 2 and 6 correspond to Comparative Examples.

Experimental Example 1

The nozzle body was formed as a cylindrical member not having the intake hole formed in the lateral surface, and the cap member was given as a plug plugged into an opening of the cylindrical member (see FIG. 7). The starting rod was inserted in the nozzle body before the start of casting. At the start of the casting, the cap member was pushed out to fall by the starting rod. Then, the starting rod was lifted and a cast product was obtained.

Experimental Example 2

The nozzle body was formed as a cylindrical member not having the intake hole formed in the lateral surface, and the cap member was given as a lid closing an opening of the cylindrical member (see FIG. 7). The starting rod was inserted in the nozzle body before the start of casting. At the start of the casting, the cap member was pushed off to fall by the starting rod. Then, the starting rod was lifted and a cast product was obtained.

Experimental Example 3

The nozzle body was formed as a cylindrical member having the intake hole formed in the lateral surface, and a lower opening of the cylindrical member was closed by the cap member including the flange portion projecting beyond the nozzle body on the outer peripheral side (see FIGS. 3 and 7). The starting rod was inserted in the nozzle body before the start of casting. At the start of the casting, the cap member was kept attached to the nozzle body. Then, the starting rod was lifted and a cast product was obtained. It is to be noted that a photo in FIG. 7 represents the nozzle taken out after the casting and including slag adhered thereto when the nozzle was taken out.

Experimental Example 4

The nozzle body was formed as a cylindrical member having the intake hole formed in the lateral surface, and a lower opening of the cylindrical member was closed by the cap member having the flange portion provided with the outer edge wall formed at the outer peripheral edge of the flange portion (see FIGS. 4 and 7). The starting rod was inserted in the nozzle body before the start of casting. At the start of the casting, the cap member was kept attached to the nozzle body. Then, the starting rod was lifted and a cast product was obtained.

Experimental Example 5

The nozzle body was formed as a cylindrical member having the intake hole formed in the lateral surface, and a lower opening of the cylindrical member was closed by the cap member having the flange portion provided with the rising wall formed between the outer peripheral edge of the flange portion and the nozzle body (see FIGS. 2 and 6). The starting rod was inserted in the nozzle body before the start of casting. At the start of the casting, the cap member was kept attached to the nozzle body. Then, the starting rod was lifted and a cast product was obtained.

(Casting Process and Evaluation)

A vertical upwards continuous casting process was performed using the nozzles in Experimental Examples 1 to 5. The composition of the raw materials was set as a Cu-5 at % Zr alloy, and a copper wire and a steel pipe containing a Cu-50 mass % Zr mother alloy were supplied from the material supply unit. A molten metal was prepared in the state in which the first storage section and the second storage section were heated to 1573K by the heating unit and Ar gas was introduced for suppression of oxidation. In the continuous casting, the die with the inner diameter of 14 mm was used and an operation of pulling up the cast product by servo-driven pinch rollers was intermittently carried out to perform the continuous casting under the condition of an average casting speed being 600 mm/min. Regarding the prevention of slag adhesion at the time of putting the nozzle into the molten metal, a very small amount of the adhering slag was evaluated as "AA", a considerably small amount of the adhering slag was evaluated as "A", and a relatively small amount of the adhering slag was evaluated as "B". Furthermore, regarding the prevention of intrusive mixing of the inclusions during the casting, a very small amount of the mixed inclusions was evaluated as "AA", a considerably small amount of the mixed inclusions was evaluated as "A", a relatively small amount of the mixed inclusions was evaluated as "B", and a large amount of the mixed inclusions was evaluated as "D".

(Results and Reviews)

Figure 8A:
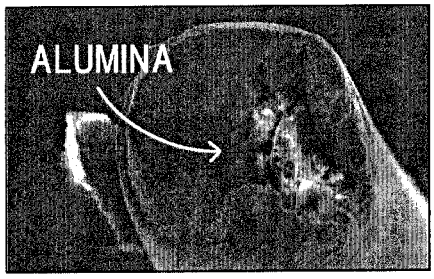
FIGS. 8A and 8B represent electron microscopic photos of cast products into which inclusions are intrusively mixed.
Figure 8B:
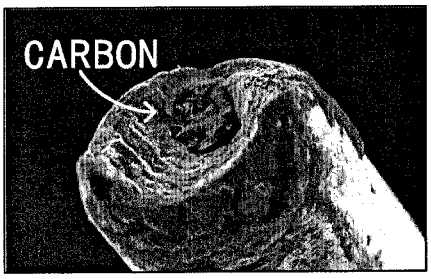

FIG. 7 is an explanatory view representing experimental results of Experimental Examples 1 to 5 regarding the prevention of slag adhesion at the time of putting the nozzle into the molten metal and the prevention of intrusive mixing of the inclusions during the casting. As seen from FIG. 7, in Experimental Examples 1 and 2, the effect of preventing the slag adhesion at the time of putting the nozzle into the molten metal was recognized. However, the inclusions floating upwards from below were taken into the nozzle during the casting, and the inclusions were intrusively mixed into the cast product. FIGS. 8A and 8B represent electron microscopic photos of cast products into which the inclusions were intrusively mixed. More specifically, FIG. 8A represents the cast product into which alumina was mixed, and FIG. 8B represents the cast product into which carbon was mixed. In each of Experimental Examples 1 and 2, there occurred a cut in the cast product due to the intrusive mixing of the inclusions. On the other hand, in Experimental Examples 3 to 5, it was understood that the intrusive mixing of the inclusions during the casting was suppressed and good cast products were obtained. In particular, it was further understood that the more satisfactory result was obtained by using the nozzle of Experimental Example 5. Moreover, in the case of using the Cu—Zr alloy, the following point is estimated. Because a nano-layered structure with high strength and high conductivity is formed, the necessity of preventing the intrusive mixing of the inclusions is high, and the significance of using the nozzles of Experimental Examples 3 to 5 is very high.

Experimental Examples 6 and 7

Next, the effect of the bubbling in the inclusion removal step was studied. The cast product manufacturing method in which the bubbling with Ar gas was not performed in the above-described casting process evaluation test before starting the vertical upwards continuous casting process using the nozzle of Experimental Example 5 was defined as Experimental Example 6. The cast product manufacturing method (see FIGS. 5A to 5C) in which the bubbling was performed in the above-described casting process evaluation test by supplying Ar gas through a lance pipe (made of porous carbon) before starting the vertical upwards continuous casting process using the nozzle of Experimental Example 5 was defined as Experimental Example 7. Rolling and die wire drawing were performed such that the cast product was shaped into a Cu—Zr wire with a diameter of 80 μm. The results of manufacturing evaluation are listed in Table 1. As seen from Table 1, in Experimental Example 6 in which the bubbling was not performed before the casting step, the number of disconnections was large, i.e., 40, and an average length was 21000 m. In contrast, in Experimental Example 7 in which the bubbling was performed before the casting step, the number of disconnections was 9 and an average length was 95000 m. Thus, a significant effect resulting from combination of the bubbling with the nozzle was confirmed.

TABLE 1

| | Experimental Example 6: No Bubbling | | | Experimental Example 7: Bubbling | | |
|---|---|---|---|---|---|---|
| | Whole length Ten thousand m | Number of disconnections | Average length Ten thousand m | Whole length Ten thousand m | Number of disconnections | Average length Ten thousand m |
| Casting top | 13.3 | 0 | 13.3 | 12.8 | 1 | 6.4 |
| | 8.5 | 2 | 2.8 | 10.2 | 4 | 2.0 |
| | 10.7 | 1 | 5.3 | 10.7 | 0 | 10.7 |
| | 10.4 | 12 | 0.8 | 9.0 | 3 | 2.3 |
| | 10.7 | 6 | 1.5 | 11.1 | 0 | 11.0 |
| | 7.1 | 6 | 2.5 | 9.1 | 1 | 1.5 |
| | 11.6 | 3 | 2.9 | 11.0 | 0 | 11.0 |
| Casting bottom | 9.3 | 7 | 1.2 | 10.9 | 0 | 10.9 |
| | 5.7 | 3 | 1.4 | 10.4 | 0 | 10.4 |
| Total | 87.3 | 40 | 2.1 | 95.2 | 9 | 9.5 |

It is needless to say that the present disclosure is not limited to the above embodiment and it can be variously implemented in various forms insofar as falling within the technical scope of the present disclosure.

The present application claims priority of Japanese Patent Application No. 2017-070975 filed on Mar. 31, 2017, the entire contents of which are incorporated herein by reference.

What is claimed is:

1. A nozzle put into a molten metal in vertical upwards continuous casting for casting a cast product by pulling up the molten metal, the nozzle comprising:

an upper cap;

a nozzle body having an intake hole through which the molten metal is taken in; and a flange portion formed on a lower side of the nozzle body, with the nozzle body, which has an extending direction, comprising a hollow cylindrical passage having constant inner and outer diameters that extend from the upper cap to a lowermost opening in the hollow cylindrical passage that is fluidly closed by the flange portion, which projects outwardly beyond the outer diameter of the hollow cylindrical passage of the nozzle body, such that the intake hole is formed in a lateral surface of the hollow cylindrical passage at a distance above the lowermost opening in the hollow cylindrical passage and extends to the outer diameter of the hollow cylindrical passage in a direction perpendicular to the extending direction of the nozzle body.

2. The nozzle according to claim 1, wherein the flange portion is formed entirely along an outer peripheral side of the nozzle body.

3. The nozzle according to claim 1, wherein the flange portion includes an outer edge wall formed at an outer peripheral edge of the flange portion and vertically rising in a fashion coming closer to the intake hole.

4. The nozzle according to claim 1, wherein the flange portion includes a rising wall formed between an outer peripheral edge of the flange portion and the nozzle body and vertically rising in a fashion coming closer to the intake hole.

5. The nozzle according to claim 1, wherein the flange portion is a cap member disposed at a tip of the nozzle body.

6. The nozzle according to claim 1, wherein the nozzle is used for the molten metal of one or more among Cu—Zr, Cu—Sn, Cu—Fe and Cu—Ag alloys and multi-element copper alloys containing some of the above-mentioned elements.

7. A casting apparatus that carries out vertical upwards continuous casting for casting a cast product by pulling up a molten metal, the casting apparatus comprising:

a storage section storing the molten metal;

an inclusion removal unit put into the storage section, performing bubbling in the molten metal with inert gas, and causing inclusions in the molten metal to float upwards;

the nozzle according to claim 1, the nozzle being put into the storage section and taking in the molten metal; and a cooling unit disposed above the nozzle and quenching the taken-in molten metal.

8. A cast product manufacturing method of carrying out vertical upwards continuous casting for casting a cast product by pulling up a molten metal, the cast product manufacturing method comprising:

an inclusion removal step of performing bubbling in the molten metal with inert gas and causing inclusions in the molten metal to float upwards; and a casting step of, after the inclusion removal step, moving the nozzle according to claim 1 downwards to be put into the molten metal, taking in the molten metal, and casting the cast product.

9. The cast product manufacturing method according to claim 8, wherein, in the casting step, the molten metal having been pulled up through the nozzle is cooled by a cooling unit disposed above the nozzle.

10. The cast product manufacturing method according to claim 8, wherein, in the inclusion removal step, the bubbling is performed in the molten metal of one or more among Cu—Zr, Cu—Sn, Cu—Fe and Cu—Ag alloys and multi-element copper alloys containing some of the above-mentioned elements.

* * * * *